US006546770B1

(12) United States Patent
Ma

(10) Patent No.: US 6,546,770 B1
(45) Date of Patent: Apr. 15, 2003

(54) LOCK ASSEMBLY

(75) Inventor: Chuang Ma, Shenyang (CN)

(73) Assignee: Danhong, Chino Hills, CA (US)

( * ) Notice: Subject to any disclaimer, the term of this patent is extended or adjusted under 35 U.S.C. 154(b) by 206 days.

(21) Appl. No.: 09/669,773

(22) Filed: Sep. 22, 2000

Related U.S. Application Data

(60) Provisional application No. 60/229,259, filed on Aug. 30, 2000.

(51) Int. Cl.[7] ..... E05B 27/00

(52) U.S. Cl. ..... 70/493; 70/425; 70/276; 292/144

(58) Field of Search ..... 70/490–493, 275, 70/276, 404, 408, 397, 413, 425, 455, 423, 427; 292/144

(56) References Cited

U.S. PATENT DOCUMENTS 3,656,328 A * 4/1972 Hughes ..... 70/276
3,665,740 A * 5/1972 Taniyama ..... 70/276
3,705,508 A * 12/1972 Fritsch et al. ..... 70/455 X
3,732,711 A * 5/1973 Albert ..... 70/425
3,950,018 A * 4/1976 Pickering ..... 292/144
4,021,066 A * 5/1977 McShane ..... 292/144
4,169,616 A * 10/1979 Peterson ..... 292/144
4,253,320 A * 3/1981 Schwab et al. ..... 70/276
4,266,415 A * 5/1981 Clarke ..... 70/275
4,365,491 A * 12/1982 Rubinstein et al. ..... 70/425
4,380,162 A * 4/1983 Woolfson ..... 70/276
4,423,611 A * 1/1984 Neyret et al. ..... 70/455
4,465,311 A * 8/1984 Austin ..... 292/144
4,476,701 A * 10/1984 Herriott ..... 70/276
4,575,136 A * 3/1986 Keller ..... 292/144
4,773,243 A * 9/1988 Lukich ..... 70/425
5,410,898 A * 5/1995 Shieh ..... 70/276
5,732,842 A * 3/1998 Krause et al. ..... 70/425 X
5,934,121 A * 8/1999 Chen ..... 70/455 X
6,041,628 A * 3/2000 Lin ..... 70/276
6,106,032 A * 8/2000 Och ..... 292/207

* cited by examiner

*Primary Examiner*—Suzanne Dino Barrett
(74) *Attorney, Agent, or Firm*—Raymond Y. Chan; David and Raymond Patent Group

(57) ABSTRACT

A lock assembly includes a barometric lock cylinder for actuating a latch assembly wherein the barometric lock cylinder including a lock body having an axial rotor hole and a plurality of marble sockets radially distributed on an inner surface of the lock body, a plurality of marbles being coaxially placed in the marble sockets respectively, a tubular compound lock core being rotatably and coaxially fitted in the axial rotor hole of the lock sleeve to define a keyway therethrough, the lock core having a plurality of locking holes radially distributed on an outer circumferential surface of the lock core and a plurality of air channels radially distributed on an inner circumferential surface of the lock core for communicating with the locking holes respectively, and a plurality of resilient elements being coaxially disposed in the marble sockets respectively, and a barometric key including a key handle having a compressible air bag provided therein and a key body having an air conduit longitudinally extended from the air chamber and a plurality of airways, which are radially extended through the air conduit respectively, provided around the key body corresponding to the axial and radial positions of the air channels in the barometric lock cylinder respectively.

12 Claims, 2 Drawing Sheets

LOCK ASSEMBLY

CROSS REFERENCE OF RELATED APPLICATION

This is a regular application of a provisional application having an application No. of 60/229,259, filed on Aug. 30, 2000.

BACKGROUND OF THE PRESENT INVENTION

1. Field of Invention

The present invention relates to lock and key, and more particularly to a lock assembly comprising a barometric lock cylinder associated with a barometric key to provide not only the locking permutations but also the barometric engagement so as to ensure the security function of the locking assembly.

2. Description of Related Arts

The conventional lock and key assembly, such as barrel lock, utilizes specific engagement or disengagement between a plurality of pin-tumblers in the lock cylinder and the key's serrations correspondingly to control the locking and unlocking functions thereof.

Virtually, all mechanical locking devices are subject to tempering, possibly resulting from loss of keys, duplication of keys, and picking due to its limited mechanical structure and theory. Thus, the pin-tumblers of such conventional lock assembly can be seen through the lock cylinder such that the pin-tumblers can respectively be pressed in order to unlock the lock assembly.

Moreover, the serrations of the key may be repeatedly duplicated such that the key can open several locks by fully inserting the key into the lock cylinder or just half way of the lock cylinder to match the pin-tumblers thereof.

For security purpose, an electronic lock assembly having a predetermined cipher preset therein is provided recently. However, the electronic lock assembly is too expensive to install since it must be incorporated with a computer such that the electronic lock assembly cannot be popular in use. Thus, the electronic lock assembly can be easily opened by someone who hacks in the computer or by decoding the cipher.

SUMMARY OF THE PRESENT INVENTION

A main object of the present invention is to provide a lock assembly which comprises a barometric lock cylinder associated with a barometric key to provide not only the locking permutations but also the barometric engagement so as to ensure the security function of the locking assembly.

Another object of the present invention is to provide a lock assembly which avoids the drawbacks of easy picking and key duplicating of the conventional mechanical lock and key assembly by eliminating the serrations of the keys with a simply rod liked magnetic key to associate with a mechanical lock cylinder by fitting into a circular keyway thereof.

Another object of the present invention is to provide a lock assembly wherein the arrangement of the tumblers, which is not limited to one or two opposing rows as in the mechanical lock and key assembly, can include any possible number of tumblers aligned around anywhere of the entire cylindrical surfaces of the key and keyway correspondingly, so that the present invention can provide more locking permutations and combinations to ensure the security function of the lock assembly.

Another object of the present invention is to provide a lock assembly which requires a barometric engagement between the lock cylinder and the key such that even though the key's serrations match the tumblers of the lock cylinder, the lock assembly cannot be opened without matching the barometric engagement.

Another object of the present invention is to provide a lock assembly which further comprises a cipher lock arrangement preset in the lock cylinder so as to further ensure the security function of the lock assembly.

Another object of the present invention is to provide a lock assembly wherein the tumblers are hidden behind the lock cylinder surfaces, which cannot be seen through the keyway, so as to prevent the lock assembly from being intentionally unlocked by any tools through the keyway.

Accordingly, in order to accomplish the above objects, the present invention provides a lock assembly, comprising:

a barometric lock cylinder for actuating a latch assembly wherein the barometric lock cylinder comprises:

a lock sleeve having an axial rotor hole and a plurality of tumbler sockets radially distributed on an inner surface of the lock sleeve;

a plurality of tumblers being coaxially placed in the tumbler sockets respectively;

a tubular lock core being rotatably and coaxially fitted in the axial rotor hole of the lock sleeve to define a keyway therethrough, the lock core having a plurality of locking holes radially distributed on an outer circumferential surface of the lock core and a plurality of air channels radially distributed on an inner circumferential surface of the lock core for communicating with the locking holes respectively, wherein each of the locking holes is capable of coaxially aligning with the tumbler sockets respectively; and a plurality of resilient elements being coaxially disposed in the tumbler sockets respectively for applying urging pressures on the tumblers to move inwardly towards the locking holes until an inner portion of each of the tumblers is disposed in the respective locking hole and an outer portion of the tumbler is disposed in the respective tumbler socket so as to lock up the rotatable movement between the lock core and the lock sleeve; and a barometric key comprising:

a key head having a compressible air chamber provided therein; and a key body having an air conduit longitudinally extended from the air chamber and a plurality of airways, which are radially extended through the air conduit respectively, provided around the key body corresponding to the axial and radial positions of the air channels in the barometric lock cylinder respectively, such that when the barometric key is inserted into the keyway, a predetermined air pressure applied from the key head is adapted to drive the tumblers to move outwardly into the tumbler sockets correspondingly, so as to unlock the barometric lock cylinder to enable the lock core freely rotating to control the locking and unlocking of the latch assembly.

DETAILED DESCRIPTION OF THE PREFERRED EMBODIMENT

Figure 1:
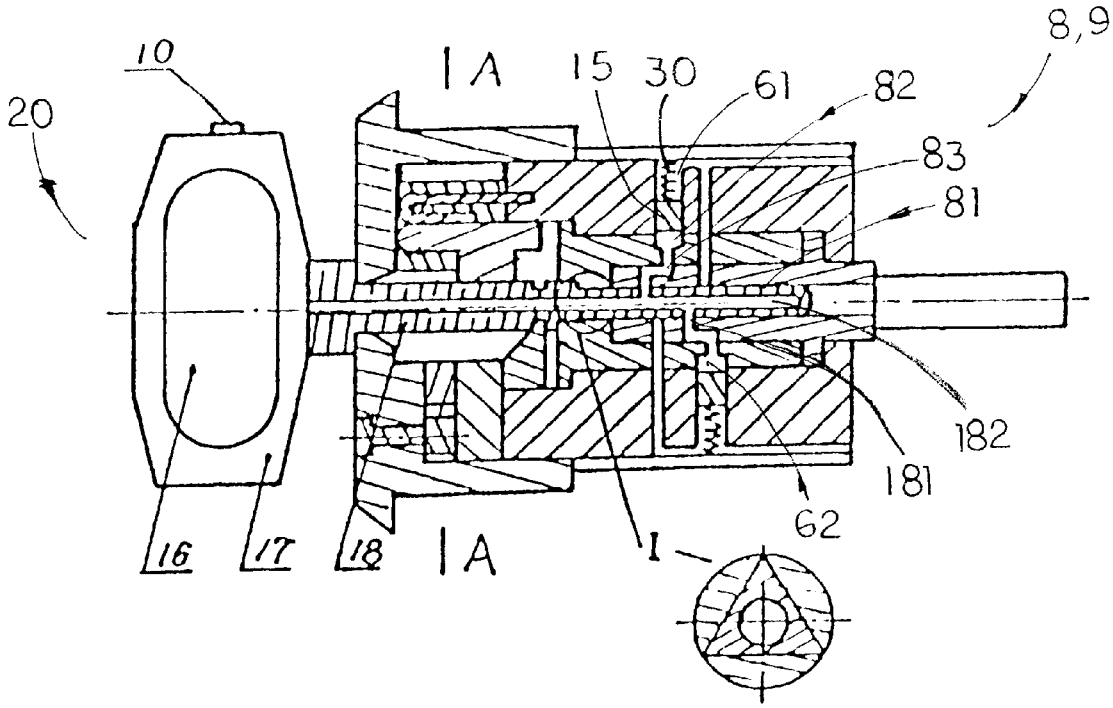
FIG. 1 is a side sectional view of a lock assembly according to a preferred embodiment of the present invention.
Figure 2:
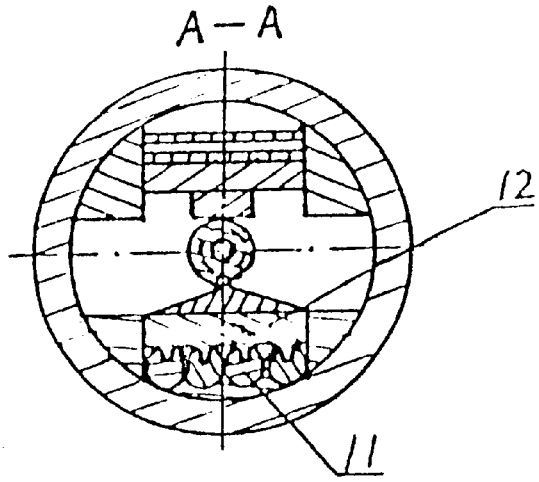
FIG. 2 is a front sectional view of the lock assembly according to the preferred embodiment of the present invention.

Referring to FIG. 1, a lock assembly comprises a lock head, a barometric lock cylinder rearwardly extended from the lock head for actuating a latch assembly, and a barometric key 20.

As shown in FIGS. 1 to 6 the lock head comprises a lock face 1 having a key hole provided thereon, a lock frame 2 rearwardly extended on the lock face 1, a spring housing 3 extended from the lock frame 2, a key hole block hanging door 5 foldably mounted on the lock frame 2 for closing and opening the key hole, and a restoring leaf spring 4 received In the spring housing 3 for applying an urging pressure on the hanging door 5. The lock face 1 further comprises an elevator wheel 11 rotatably mounted on the lock face 1, a fender 12 controlled by the elevator wheel 11 for blocking up the hanging door 5 on the key hole, and a fender sliding track 13 for guiding the rotation movement of the fender 12.

The lock assembly further comprises a set of cipher wheels 19 having a preset cipher provided on a front surface of the lock face 1 wherein the cipher wheels 19 are communicating with the elevator wheel 11 in such a manner that when the cipher wheels 19 are selectively rotated to match the preset cipher, the fender 12 is slidably moved along the fender sliding track 13, so as to unblock the hanging door 5. At the time when the fender 12 is moved away from the hanging door 5, the hanging door 5 will not automatically open the key hole so as to enhance the secure ability of the lock assembly.

It is worth to mention that when one of the cipher wheels 19 is rotated, the rest of the cipher wheels 19 are driven to rotate simultaneously. Thus, in order to unlock the fender 12, all cipher wheels 19 should be rotated in turn such that more combinations of the cipher can be provided by increasing the cipher wheels 19. For old persons and children to remember the cipher conveniently, the cipher can be changed simply by changing the connecting direction between the cipher wheels 19 and the elevator wheel 11. Also, each cipher wheel 19 has a predetermined graduation as if a mark of a clock for the user to rotate the cipher wheels 19 precisely.

Figure 3:
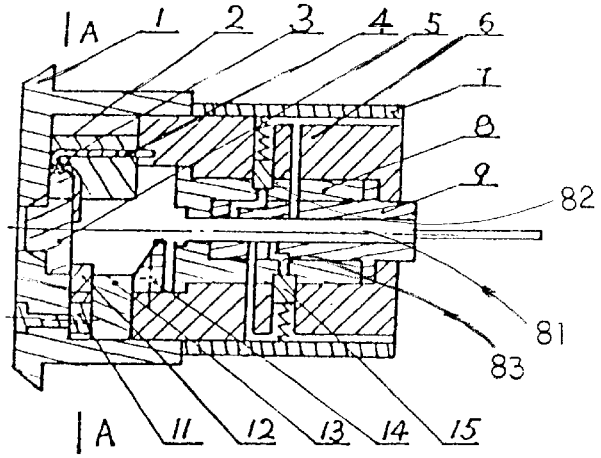
FIG. 3 is a sectional view of the lock cylinder having a barometric key inserted therein according to the preferred embodiment of the present invention.

Referring to FIGS. 1 and 3, the barometric lock cylinder comprises a lock body 6, a lock sheath 7, a plurality of hidden marbles 15, a tubular compound lock core 8, 9, and a positioner 14. In a locking position, the hidden marbles 15 block the compound lock core 8, 9 and the lock body 6 which is coaxially connected to the lock sheath 7.

The lock body 6 has an axial rotor hole 61 and a plurality of marble sockets 62 radially distributed on an inner surface of the lock body 6.

The plurality of hidden marbles 15 are coaxially placed in the marble sockets 62 respectively wherein each of the hidden marbles 15 must be equal to or shorter than the respective marble socket 62 of the lock body 6.

The tubular compound lock core 8, 9 is rotatably and coaxially fitted in the axial rotor hole 61 of the lock body 6 to define a keyway 81 aligning with the key hole of the key head. The lock core 8, 9 has a plurality of locking holes 82 radially distributed on an outer circumferential surface of the lock core 8, 9 and a plurality of air channels 83 radially distributed on an inner circumferential surface of the lock core 8, 9 for communicating with the locking holes 82 respectively. Each of the locking holes 82 is capable of coaxially aligning with the marble sockets 62 respectively and each of the locking holes 82 has a depth shorter than a length of respective hidden marble 15.

Accordingly, each locking hole 82 has a diameter larger than a diameter of the air channel 83 such that the respective hidden marble 15 can only sit in the locking hole 82 without sliding into the air channel 83. Thus, each of the air channels 83 can be bent and extended from the inner circumferential surface of the lock core 8, 9 to the respective locking hole 82 for security purpose such that the hidden marbles 15 are not only hidden behind the air channels 83 but also unable to determine the locations of the hidden marbles 15 by determining the locations of the air channel 83 through the keyway 81. In other words, even though other people can open the hanging door 5 of the key hole, they cannot see the hidden marbles 15 through the keyway 81.

A plurality of resilient elements 30, which are compression springs according to the preferred embodiment, are coaxially disposed in the marble sockets 62 respectively for applying urging pressures on the hidden marbles 15 to move inwardly towards the locking holes 82 until an inner portion of each of the hidden marbles 15 is disposed in the respective locking hole 82 and an outer portion of the hidden marble 15 is disposed in the respective marble socket 62 so as to lock up the rotatable movement between the lock core 8, 9 and the lock body 6.

As shown in FIG. 1, the barometric key 20 comprises a key handle 17 and a rod like shaped key body 18 extended therefrom for controlling the locking and unlocking of the latch assembly wherein a blocking groove is formed on a rear portion of the key body 18 for predetermining the length of the barometric key 20 should be inserted into the barometric lock cylinder.

The key handle 17 has a compressible air bag 16, which is made of flexible material such as plastic, provided therein wherein a predetermined volume of air is trapped inside the air bag 16 in such a manner when an compression force is applied on the key handle 17 for applying an predetermined air pressure, the air inside the air bag 16 is adapted for releasing from the air bag 16, and when the compression force is released, the air bag 16 is reformed to its original shape for restoring the same predetermined volume of air therein.

The key body 18 has an air conduit 181 longitudinally extended from the air bag 16 of the key handle 17 and a plurality of airways 182, which are radially extended through the air conduit 181 respectively, provided around the key body 18 corresponding to the axial and radial positions of the air channels 83 in the barometric lock cylinder respectively such that when the barometric key 20 is inserted into the keyway 81 of the barometric lock cylinder, the predetermined air pressure from the key handle 17 Is adapted to drive the hidden marbles 15 to move outwardly into the marble sockets 62 correspondingly, so as to unlock the barometric lock cylinder to enable the lock core 8, 9 to freely rotate to control the locking and unlocking of the latch assembly.

Moreover, each of the hidden marbles 15 and the respective airway 182 should be coaxially aligned in a perpendicular manner with the axis of the keyway 81 of the barometric lock cylinder.

Referring to FIG. 1, the key body 18 of the barometric key 20 according to the preferred embodiment has a triangular cross section having three engaging surfaces for fittedly inserting into the corresponding shape of the keyway 81 wherein the airways 182 are selectively aligned on each engaging surface of the key body 18 so as to control the hidden marbles 15 In the barometric lock cylinder in three radial directions. So, the locking permutations and combinations of the lock assembly are selectively formed by the locations of the hidden marbles 15 to ensure the security function of the lock assembly. locking permutations and combinations of the lock assembly are selectively formed by the locations of the hidden marbles 15 to ensure the security function of the lock assembly.

Figure 4:
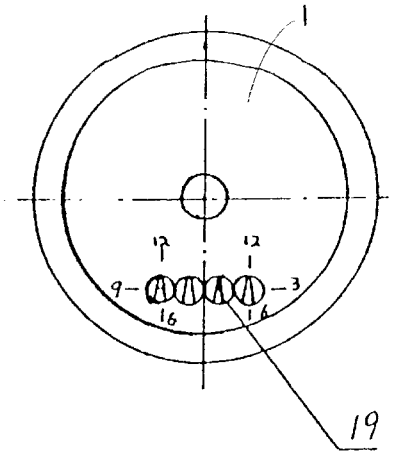
FIG. 4 is a front view of the lock face of the lock assembly according to the preferred embodiment of the present invention.
Figure 5:
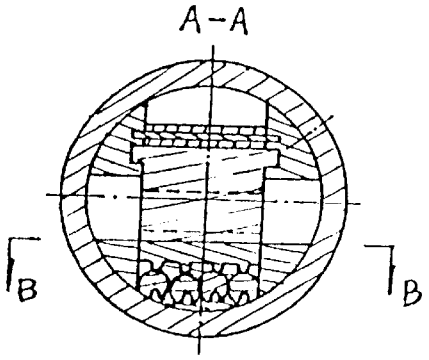
FIG. 5 is a front sectional view of the lock assembly according to the preferred embodiment of the present invention.
Figure 6:
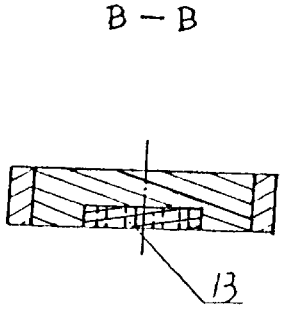
FIG. 6 is a top sectional view of the lock assembly according to the preferred embodiment of the present invention.

For turning the cipher wheels 19 easily, as shown in FIGS. 1 and 4, a protruding part 10 is outwardly protruded from the key handle 17 of the barometric key 20, wherein the protruding part 10 is arranged to engage with the cipher wheels 19 in order to rotate the cipher wheels 19 easily.

To operate the lock assembly, the protruding part 10 on the key handle 17 should be selectively engaged with the cipher wheels 19 in turn in such a rotatably movable manner in order to drive the elevator wheel 11 to rotate. When matching the preset cipher, the fender 12 will be slidably moved along the fender sliding track 13 in order to unblock the hanging door 5. At this time, the barometric key is adapted to insert into the keyway 81 through the key hole.

When the barometric key 20 is inserted into the keyway 81 of the barometric lock cylinder, a user is able to compress the key handle 17 such that air inside the air bag 16 will be released to the air channels 83 of the barometric lock cylinder through the airways 182 of the key body 18. Due to the air pressure, the hidden marbles 15 are driven to move outwardly into the marble sockets 62 respectively, which will compress the resilient elements 30 respectively, so as to unlock the barometric lock cylinder to enable the lock core 8, 9 freely rotating to control the locking and unlocking of the latch assembly. When the compression force applied on the key handle 17 is released, the deformed air bag 16 will be returned to its original shape and restored the air back to the air bag 16. The air pressure applied on the hidden marbles 15 will be vanished such that the compressed resilient elements 30 will be rebounded to their original forms, which will push the hidden marbles 15 back to the original arranged locking holes 82 in such a lockup position.

Otherwise, if the barometric key 20 is inserted into a non-corresponded barometric lock cylinder, which one of the airways 182 is in different arrangement, the hidden marble 15 is sat on the locking hole 82 of the lock core 8, 9 because no air pressure can be applied on the hidden marble 15. So, the hidden marbles 15 act as a locking latch to lock the rotation of the lock core 8, 9 and keep in the locking condition.

After the barometric key 20 is pulled out from,the keyway 81, the compressed leaf spring 4 will rebound to its original form, which will automatically drive the hanging door 5 back on the key hole in order to close the keyway 81. So, the keyway 81 is normally closed by the hanging door 5, which will prevent dust from outside for interfering the air pressure passing from the airways 182 to the air channels 83. Since when the dust get stuck on the air channels 83, the air pressure may not effectively apply on the hidden marbles 15 through the air channels 83, which will affect the function of locking and unlocking the latch assembly.

What is claimed is:

1. A lock assembly, comprising:

a barometric lock cylinder for actuating a latch assembly wherein the barometric lock cylinder comprises:

a lock body having an axial rotor hole and a plurality of marble sockets radially distributed on an inner surface of said lock body;

a plurality of hidden marbles being coaxially placed in said marble sockets respectively;

a tubular compound lock core being rotatably and coaxially fitted in said axial rotor hole of said lock body to define a keyway therethrough, said lock core having a plurality of locking holes radially distributed on an outer circumferential surface of said lock core and a plurality of air channels radially distributed on an inner circumferential surface of said lock core for communicating with said locking holes respectively, wherein each of said locking holes is capable of coaxially aligning with said marble sockets respectively; and a plurality of resilient elements being coaxially disposed in said marble sockets respectively for applying urging pressures on said hidden marbles to move inwardly towards said locking holes until an inner portion of each of said hidden marbles is disposed in said respective locking hole and an outer portion of said hidden marble is disposed in said respective marble socket so as to lock up said rotatable movement between said lock core and said lock body; and a barometric key comprising:

a key handle having a compressible air bag provided therein; and a key body having a rod liked shape comprising an air conduit longitudinally extended from said air bag and a plurality of airways, which are radially extended outwardly from said air conduit respectively, provided around said key body corresponding to said axial and radial positions of said air channels in said barometric lock cylinder respectively, such that when said barometric key is inserted into said keyway, a predetermined air pressure applied from said key handle is adapted to drive said marbles to move outwardly into said marble sockets correspondingly, so as to unlock the barometric lock cylinder to enable said lock core to freely rotate to control said locking and unlocking of said latch assembly.

2. The lock assembly, as recited in claim 1, wherein each of said barometric key having a triangular cross section has three engaging surfaces for fittedly inserting into said corresponding shape of said keyway having a triangular cross section wherein said airways are selectively aligned on each engaging surface of said key body in such a axial and radial positions so as to control said marbles in said barometric lock cylinder in three radial directions.

3. The lock assembly, as recited in claim 1, wherein each of said air channels is bent and extended from said inner circumferential surface of said lock core to said respective locking hole for security purpose.

4. The lock assembly, as recited in claim 2, wherein each of said air channels is bent and extended from said inner circumferential surface of said lock core to said respective locking hole for security purpose.

5. The lock assembly, as recited in claim 2, further comprising a lock head comprising a lock face having a key hole aligning with said keyway, a lock frame rearwardly extended on said lock face, a spring housing extended from said lock frame, a key hole block hanging door foldably mounted on said lock frame for closing and opening said key hole, and a restoring leaf spring received in said spring housing for applying an urging pressure on said hanging door.

6. The lock assembly, as recited in claim 4, further comprising a lock head comprising a lock face having a key hole aligning with said keyway, a lock frame rearwardly extended on said lock face, a spring housing extended from said lock frame, a key hole block hanging door foldably mounted on said lock frame for closing and opening said key hole, and a restoring leaf spring received in said spring housing for applying an urging pressure on said hanging door.

7. The lock assembly, as recited in claim 5, wherein said lock face further comprises an elevator wheel rotatably mounted on said lock face, a fender controlled by said elevator wheel for blocking up said hanging door on said key hole, and a fender sliding track for guiding the rotation movement of said fender.

8. The lock assembly, as recited in claim 6, wherein said lock face further comprises an elevator wheel rotatably mounted on said lock face, a fender controlled by said elevator wheel for blocking up said hanging door on said key hole, and a fender sliding track for guiding the rotation movement of said fender.

9. The lock assembly, as recited in claim 7, further comprising a set of cipher wheels having a preset cipher provided on a front surface of said lock face wherein said cipher wheels are communicating with said elevator wheel in such a manner that when said cipher wheels are selectively rotated to match said preset cipher, said fender is slidably moved along said fender sliding track, so as to unblock said hanging door.

10. The lock assembly, as recited in claim 8, further comprising a set of cipher wheels having a preset cipher provided on a front surface of said lock face wherein said cipher wheels are communicating with said elevator wheel in such a manner that when said cipher wheels are selectively rotated to match said preset cipher, said fender is slidably moved along said fender sliding track, so as to unblock said hanging door.

11. The lock assembly, as recited in claim 9, further comprising a protruding part outwardly protruded from said key handle of said barometric key wherein said protruding part is arranged to engage with said cipher wheels in order to rotate said cipher wheels.

12. The lock assembly, as recited in claim 10, further comprising a protruding part outwardly protruded from said key handle of said barometric key wherein said protruding part is arranged to engage with said cipher wheels in order to rotate said cipher wheels.

* * * * *